US006865829B2

(12) United States Patent
Amano et al.

(10) Patent No.: US 6,865,829 B2
(45) Date of Patent: Mar. 15, 2005

(54) BUCKET TOOTH

(75) Inventors: Masaharu Amano, Hirakata (JP); Kazuhide Okawa, Yawata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/725,314

(22) Filed: Nov. 29, 2000

(65) Prior Publication Data

US 2001/0004809 A1 Jun. 28, 2001

(30) Foreign Application Priority Data

Dec. 2, 1999 (JP) ..... 11-3431106
Jan. 20, 2000 (JP) ..... 2000-11166

(51) Int. Cl.[7] ..... E02F 9/28
(52) U.S. Cl. ..... 37/460; 37/452; 172/701.3
(58) Field of Search ..... 72/342.6, 342.94; 148/510, 644, 654; 37/446, 449, 452, 454, 455, 456, 460; 172/701.3; 411/154, 155, 156

(56) References Cited

U.S. PATENT DOCUMENTS 454,289 A * 6/1891 Partz ..... 411/155
1,885,741 A * 11/1932 Lutes ..... 37/455
2,329,831 A * 9/1943 Ferguson ..... 37/449
3,281,972 A * 11/1966 Kerestes ..... 172/698
3,648,391 A * 3/1972 Kabay et al. ..... 37/451
3,913,649 A * 10/1975 Stanaitis ..... 411/155
4,127,179 A * 11/1978 Heersink et al. ..... 172/565
4,360,982 A * 11/1982 Maurer et al. ..... 37/449
D275,757 S * 10/1984 Nja ..... D15/29
4,958,970 A * 9/1990 Rose et al. ..... 411/12
5,056,975 A * 10/1991 Ando ..... 411/155
5,112,178 A * 5/1992 Overhues et al. ..... 411/156
5,564,206 A * 10/1996 Ruvang ..... 37/455

FOREIGN PATENT DOCUMENTS

GB 2176520 A * 12/1986
JP 5-73055 10/1993
JP 11-247240 9/1999

OTHER PUBLICATIONS

Mark's Standard Handbook for Mechanical Engineers, 10th Ed. (1996), 5–1—5–5.*

* cited by examiner

*Primary Examiner*—Robert E. Pezzuto
*Assistant Examiner*—Nathan S Mammen
(74) *Attorney, Agent, or Firm*—Armstrong, Kratz, Quintos, Hanson & Brooks, LLP.

(57) ABSTRACT

A bucket tooth capable of preventing a bolt from being loosened during operation is provided. In order to allow the bucket tooth to generate a resilient return force after attachment, a warp is caused by resilient deformation so that a face on the bucket lip side becomes a concave face. As another means, a spot facing portion is formed around a bolt hole into which a fastening bolt is inserted, on the side facing the bucket lip.

6 Claims, 24 Drawing Sheets

(a)

(b)

(a)

(b)

(a)

(b)

(a)

(b) (c) (d)

(a)

(b)

BUCKET TOOTH

FIELD OF THE INVENTION

The present invention relates to a bucket tooth which is attached to a bucket of construction equipment or the like and is used mainly for a work of excavating or loading earth and sand and a method of manufacturing the bucket tooth.

RELATED BACKGROUND ART

Hitherto, the most common bucket tooth used for construction equipment or the like is of a type in which the bucket tooth is fit in an adapter fixedly provided on a bucket side and is fastened by a pin or the like. A bucket tooth of a type which is directly fastened to a bucket by using a bolt is also known.

FIGS. 23(*a*1) and 23(*a*2) through FIGS. 23(*d*1) and 23(*d*2) show examples of the bucket tooth of the latter type. In each of bucket teeth 50A, 50B, 50C, and 50D, the tip side opposite to a base portion having a plurality of bolt holes 51 is formed with a step, or the base portion is formed in a forked shape. The inner portion of the step or the inner space of the forked portion is placed in contact with the tip of a bucket lip (not shown) and the bucket tooth is fixed to the bucket lip by being bolted.

Another example of the bucket tooth of the bolting type is, as shown in FIGS. 24(*a*) and 24(*b*), a bucket tooth 60 of a shape having edges 61 at both one end and the other end and two bolt holes 62, 62 in the center. The bucket tooth 60 can be used twice in such a manner that when the edge 61 at one end is worn and becomes short to the limit, the bucket tooth 60 is turned and the edge 61 at the other end is used.

In the conventional bucket teeth shown in FIGS. 23(*a*1) and 23(*a*2) through 23(*d*1) and 23(*d*2), however, when the tip of each of the tooth becomes useless by wear, the bucket teeth 50A to 50D have to be replaced by new bucket teeth. Consequently, there is a problem such that the life is relatively short due to the wear, and since the weight of the worn portion with respect to the weight of the whole tooth is small, the yield is low.

On the contrary, in the conventional bucket tooth shown in FIGS. 24(*a*) and 24(*b*), even when one of the edges 61 is worn out, the tooth is turned and the other edge 61 can be used. Consequently, it has advantages such that the life is relatively longer in spite of the wear and the yield is higher as compared with the bucket teeth shown in FIGS. 23(*a*1) and 23(*a*2) through FIGS. 23(*d*1) and 23(*d*2). On the other hand, the bucket tooth has a problem which is common to bucket teeth of the bolting type, such that a fastening bolt is easily loosened due to vibration, shock, and the like applied to the bucket tooth during operation.

The present invention is achieved in order to solve such problems. An object of the present invention is to provide a bucket tooth to be attached by being fastened by a bolt which is prevented from being loosened during operation, and to provide a method of manufacturing the bucket tooth, which can prevent a bolt from being loosened.

SUMMARY OF THE INVENTION

In consideration that a direct cause of loosening of a fastening bolt attaching a bucket tooth to a bucket lip is reduction in axial force of the bolt during operation, the present invention has been achieved by finding out effective means which prevents the reduction in axial force.

According to a first aspect of the present invention, there is provided a bucket tooth attached to a bucket lip via a fastening bolt, comprising axial force fluctuation absorbing means for absorbing fluctuations in axial force of the fastening bolt after attaching the bucket tooth to the bucket lip.

In the present invention, preferably, after the bucket tooth is attached to the bucket lip, fluctuations in axial force of the fastening bolt are absorbed by the axial force fluctuation absorbing means. Even when fluctuations in axial force occur in the fastening bolt in association with fluctuations in a load applied to the bucket tooth during operation, the fluctuations in axial force can be absorbed, thereby enabling reduction in axial force of the fastening bolt to be prevented. Obviously, according to the bucket tooth of the present invention, by providing a bolt fastening portion in the center portion, when the tip of the tooth becomes useless due to wear, the bucket tooth is turned and the other tip of the tooth can be used. Therefore, the bucket tooth having the increased life in spite of the wear and the improved yield can be achieved.

In the present invention, preferably, the axial force fluctuation absorbing means allows the bucket tooth to generate a resilient return force by causing a warp by resilient deformation so that one face side becomes a concave face and performing bolting in a state where the one face side is positioned on the bucket lip side. In such a manner, the fastening force at the time of bolting works as an action force in the direction of canceling the warp caused in the bucket tooth, the resilient return force is generated in the bucket tooth by the action force, the fluctuations in axial force of the fastening bolt during operation are absorbed by the resilient return force, and the reduction in axial force can be prevented.

In the present invention, preferably, the warp created in the bucket tooth is caused around a bolt hole into which the fastening bolt is inserted as a center, and an amount s of the warp is set to a value satisfying an equation of $2\ \text{mm/m} \leqq s \leqq 15\ \text{mm/m}$. Specifically, when the amount s of the warp increases, an effect of preventing the reduction in axial force of the fastening bolt can be obtained. A value equal to or lower than 10% is obtained as an axial force reduction rate which does not cause any problem in practice in the case where the amount s of the warp is set to 2 mm/m or larger. When the amount s of the warp exceeds 15 mm/m, it is not preferable since an excessive tensile stress works around the bolt hole at the time of bolting and it causes delayed fracture.

In the present invention, preferably, the axial force fluctuation absorbing means allows the bucket tooth to generate a resilient return force by spot facing the circumference on the side facing the bucket lip, of a bolt hole in which the fastening bolt is inserted. In such a manner, the spot facing portion around the bolt is resilient deformed in the direction so as to be in contact with the bucket lip by the fastening force at the time of bolting, thereby generating the resilient return force in the spot facing portion. By the resilient return force, the fluctuations in axial force of the fastening bolt during operation are absorbed and the reduction in axial force can be prevented. The present invention is effective even when the bolt hole is not in the center portion of the bucket tooth. When one side of the bucket tooth of a type in which the bolt hole is in the center portion is worn, the bucket tooth is turned and the other side is used.

In the present invention, preferably, the axial force fluctuation absorbing means allows the bucket tooth to generate a resilient return force by causing a warp by resilient deformation so that one face side becomes a concave face, spot-facing the circumference on the side facing the bucket lip, of a bolt hole in which the fastening bolt is inserted, and performing bolting in a state where the one face side is positioned on a bucket lip side. By warping the bucket tooth and forming the spot facing portion around the bolt hole in such a manner, by a synergistic effect of them, a larger resilient return force can be generated and the effect of absorbing the fluctuations in axial force of the fastening bolt can be increased.

Preferably, a ratio (z) of a depth L of the spot facing to a diameter D of the spot facing (=L/D) is set to a value satisfying an equation of 2 mm/m≦z≦18 mm/m. More specifically, when the spot facing amount (z) is increased, an effect of preventing the reduction in axial force of the fastening bolt can be obtained. However, a value equal to or lower than 10% is obtained as an axial force reduction rate which does not cause any problem in practice in the case where the spot facing amount (z) is set to 2 mm/m or larger. When the spot facing amount (z) exceeds 18 mm/m, it is not preferable since an excessive tensile stress works around the bolt hole at the time of bolting and it causes delayed fracture.

According to another aspect of the present invention, there is provided a bucket tooth attached to a bucket lip via a fastening bolt, wherein a bearing surface of the fastening bolt is formed in a tapered surface which is tapered down in an insertion direction of the fastening bolt.

In the present invention, the bearing surface of the bolt for fastening the bucket tooth can be set in the direction so as to cross the direction of a load (excavating force) acting on the bucket tooth at the time of excavation, preferably, in the direction almost perpendicular to the direction of the load. Consequently, the area for holding the axial force of the bolt increases, and the force acting on the bucket tooth can be received by the bolt bearing surface most effectively, in other words, uniformly. A local fatigue is not accordingly easily caused on the bearing surface, so that the reduction in axial force of the bolt can be prevented. As a result, the bolt can be certainly prevented from being loosened.

In the present invention, the angle of the tapered surface is preferably set within a range from 20° to 45° with respect to a center line of a bolt hole. When the angle of the tapered surface (bearing surface angle) is too large or too small, a shear component of an excavating force (load) acts on the bearing surface. Each time the load acts, a slight sliding occurs in the bearing surface and it causes increase in fatigue. When the bearing surface angle is particularly too small, the height of the head of the bolt is regulated by the thickness of the bucket tooth, the diameter of the bearing surface is reduced, and it causes a reduction in axial force. The relation between the bearing surface angle and the axial force reduction rate has been examined and found that, when the bearing surface angle is set within the range from 20° to 45°, the axial force reduction rate can be set within the allowable range. More preferable, the bearing surface angle is set to 30°.

According to another aspect of the present invention, there is provided a bucket tooth attached to a bucket lip via a fastening bolt, wherein a bearing surface of the fastening bolt is formed in a spherical curved surface which is tapered down in an insertion direction of the fastening bolt.

In the present invention, the load (excavating force) acting on the bucket tooth at the time of excavation can be directed almost perpendicular to a tangent direction of the bolt bearing surface. The load can be therefore received by the whole bolt bearing surface. Accordingly, a local fatigue does not easily occur on the bearing surface. The reduction in axial force of the bolt can be prevented and the bolt can be certainly prevented from being loosened.

According to further another aspect of the present invention, there is provided a bolted structure of any of the above bucket teeth, wherein either the bucket lip or bucket tooth is tapped, and the bucket lip and the bucket tooth are fastened to each other by a fastening bolt inserted from the other side. In such a manner, the length of the screw portion can be increased, and an effect such that the bolt is not easily loosened is therefore produced. Since the load is supported only by the bolt head, the number of fatigued portions in the bearing surface, which cause reduction in axial force is reduced. The bolt is accordingly prevented from being easily loosened.

In the present invention, there is provided a bolted structure of any of the above bucket teeth, wherein the bucket lip and the bucket tooth are fastened to each other by screwing the tip of a fastening bolt inserted from either the bucket lip or the bucket tooth into a nut on the other side. In such a manner, even though the center line of a hole through which a bolt is inserted is deviated, no application of a load on one side due to the axial deviation occurs, so that the bolt is not easily loosened. Since the length of the core of the bolt can be increased, the repetitive load acting on the bolt can be reduced. There is an advantage such that the bolt is not easily fatigued and destroyed.

According to further another aspect of the present invention, there is provided a method of manufacturing a bucket tooth which is warped so that one face side becomes a concave face, comprising the steps of: heating the bucket tooth to a predetermined temperature; and causing a warp by positively applying a coolant to an almost center portion of a face on the side opposite to a side facing a bucket lip to which the bucket tooth is attached in a quenching process after the heating.

In the present invention, the bucket tooth is preferably warped by controlling the cooling speed of the coolant in the process of quenching the bucket tooth. Consequently, the desired object can be achieved by a cheap apparatus.

In the method, preferably, a surface area of a face opposite to a side facing the bucket lip is set to be larger than that of the side facing the bucket lip, and a warp is caused due to a large transformation expanding amount of the face having the larger surface area in a quenching process.

According to the present invention, the bucket tooth is warped by making a difference in surface area by setting the surface area of the surface opposite to the side facing the bucket lip to be larger than that on the side facing the bucket lip at the time of quenching the bucket tooth. Thus, the desired object can be achieved by a cheap process.

In the method, preferably, a decarburized layer on a side opposite to a side facing the bucket lip is removed and, after that, a quenching process is performed, thereby shrinking the decarburized layer to cause a warp. Specifically, a steel product is heated to 1100° C. and subjected to blooming milling. After that, the side opposite to the side facing the bucket lip is machined to remove the decarburized layer. In such a manner, the decarburized layer is provided on the side facing the bucket lip and no decarburized layer is provided on the face on the opposite side, thereby warping the bucket tooth by using the shrinkage of the decarburized layer at the time of quenching. The tooth itself expands at the time of martensitic transformation but only the decarburized layer is shrunk. Consequently, the face having the decarburized layer becomes a concave face.

In the method of the present invention, preferably, a load may be applied to an almost center portion of a side facing the bucket lip to which said bucket tooth is attached to thereby preliminarily cause a warp after the heating and before a quenching process. As described above, both of the heat treatment method by controlling the coolant and the mechanical method can be also used to warp the bucket tooth.

DETAILED DESCRIPTION OF THE PREFERRED EMBODIMENTS

Embodiments of a bucket tooth and a method of manufacturing the bucket tooth according to the present invention will be described hereinbelow with reference to the drawings.

First Embodiment

Figure 1:
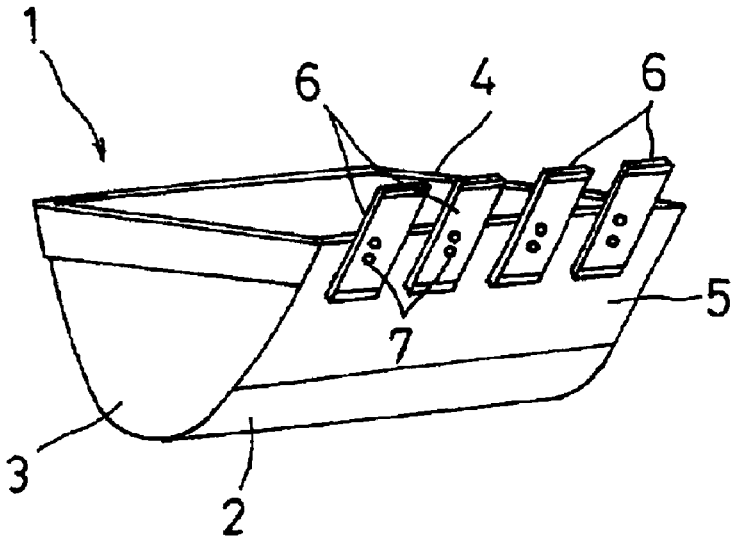
FIG. 1 is a perspective view of a bucket according to a first embodiment of the present invention.
Figure 2:
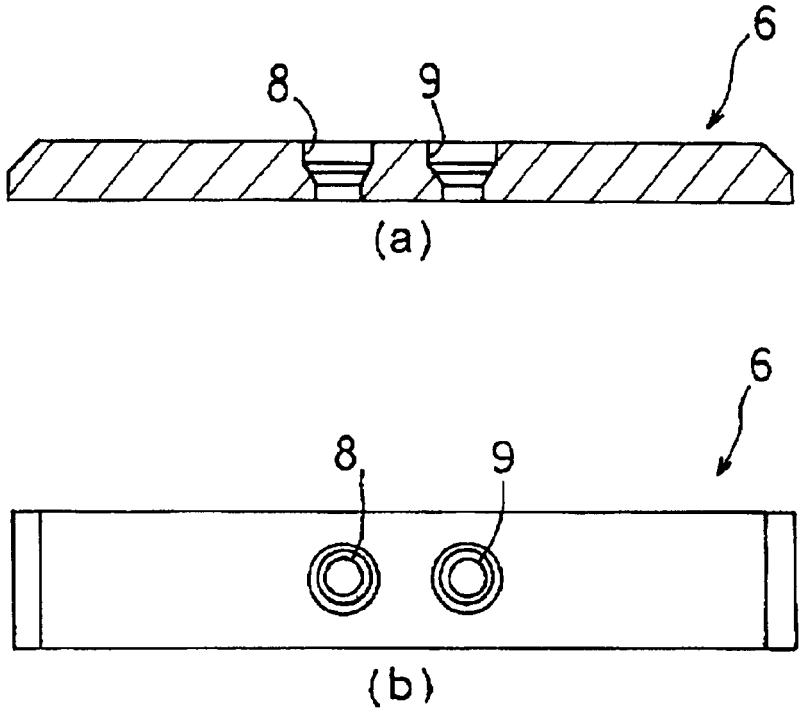
FIGS. 2(*a*) and 2(*b*) are a cross section and a plan view, respectively, of a bucket tooth in the first embodiment.

FIG. 1 is a perspective view of a bucket according to a first embodiment of the present invention. FIGS. 2(*a*) and 2(*b*) are a cross section and a plan view of a bucket tooth attached to the bucket.

In the embodiment, a bucket 1 attached to construction equipment such as a hydraulic excavator has a bottom plate 2, right and left side plates 3 and 4, and a bucket lip (hereinbelow, called a "lip") 5 provided at the front. A plurality of (four in the embodiment) bucket teeth 6 are attached to the front edge of the lip 5 by fastening bolts 7.

Each of the bucket teeth 6 is made by a metal plate (made of a material which is, for example, JIS SNCM630) and has a flat bar shape as a whole. Both ends which do not face the lip 5 are chamfered. Two bolt holes 8 and 9 are formed in the center portion and the bucket tooth 6 is constructed symmetrical with respect to the right and left sides and with respect to the upper and lower sides. The bucket tooth 6 is produced by cutting a thick plate as a material into a tooth shape by a proper method such as gas cutting, laser cutting, or plasma cutting and opening a bolt hole by a mechanical process. The base side and the tip side of the bucket tooth 6 are symmetrical with respect to the bolt holes 8 and 9 as a center. When the tooth tip on one side becomes useless by wear, the bucket tooth 6 is turned and the other tooth tip side is used. The life shortened by the wear can be accordingly increased and the yield can be improved.

Figure 3:
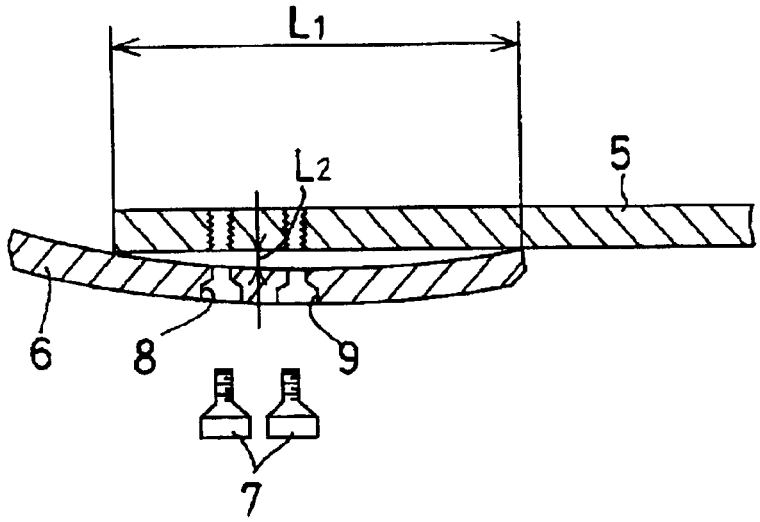
FIG. 3 is a cross section showing the shape of the tooth of the first embodiment.

The bucket tooth 6 is, as shown in FIG. 3, warped around the center portion as a center so that the side facing the lip 5 is recessed. Preferably, as obviously understood from results of bolt looseness tests which will be described hereinlater by using Table 1, the amount $s=L_2/L_1$ of warping given here is set to a value within a range of $2\ \text{mm/m} \leqq s \leqq 15\ \text{mm/m}$.

Figure 4:
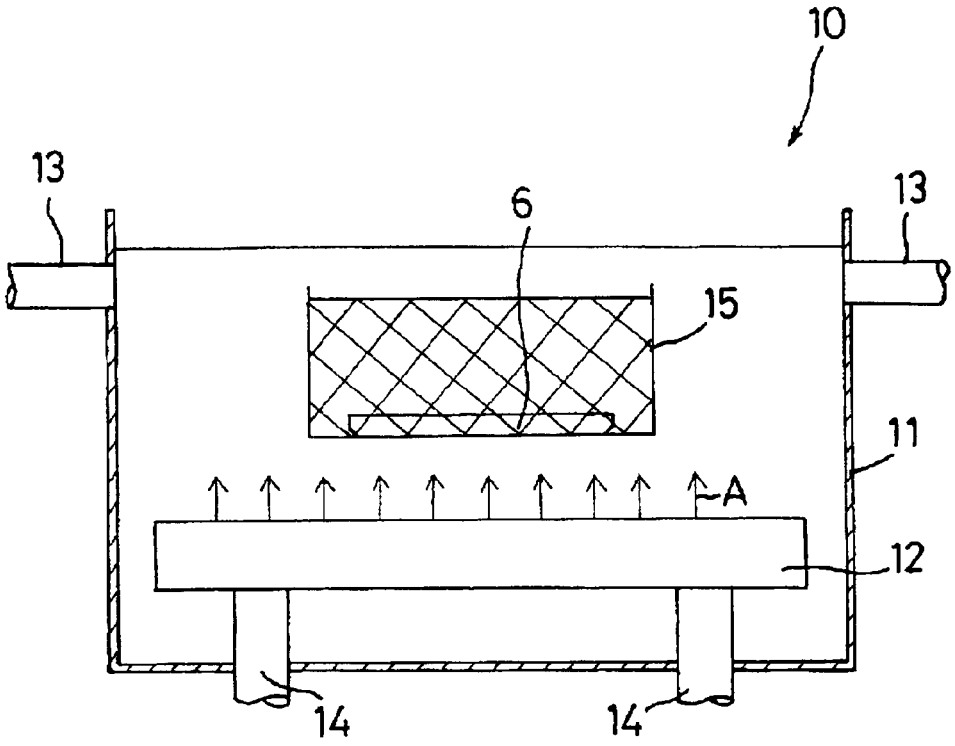
FIG. 4 is a schematic construction diagram of a quenching apparatus in the first embodiment.

In the case of warping the bucket tooth 6, the bucket tooth 6 is heated to about 900° C. by a heating furnace, high-frequency heating, or the like and, after that, subjected to a quenching process by a cooling apparatus (quenching apparatus) 10 as shown in FIG. 4.

The cooling apparatus 10 has a construction such that a jacket 12 for forming a stream is disposed in the lower part of a quenching water tank 11 and right and left drain pipes 13, 13 are connected to the upper right and left portions. In the jacket 12, a number of small holes are formed at a predetermined pitch (for example, 100 mm pitch) in the top face, and water introducing pipes 14, 14 are connected to the lower part of the jacket 12. By introducing water from a mixing pump (not shown) via the water introducing pipes 14, 14, an upward water stream is created as shown by the arrows A in the quenching water tank 11 via the small holes in the top face. A tooth holding basket 15 holding the bucket tooth 6 is suspended by a crane or the like so as to be held above the jacket 12, so that the water stream injected from the jacket 12 hits one of the faces of the bucket tooth 6. Consequently, the cooling speed (quenching speed) on one face side is accelerated. In this case, by holding the bucket tooth 6 with the side to be in contact with the lip 5 facing upward in the tooth holding basket 15, the bucket tooth 6 is warped so that the top face becomes concave according to the difference of the quenching speed.

Heat treatment conditions adopted in the embodiment are as follows.

quenching temperature: holding for 15 minutes after the temperature reaches austenitizing temperature (880° C.)

coolant for quenching and its temperature: water, 22° C.

the number of mixing pumps and flow rate: two, 80 litters/minute tooth lifting temperature: when completely cooled After such a quenching process, a tempering process is performed at 200° C. The bucket tooth 6 (having the thickness of 70 mm) obtained in the above manner has tooth surface hardness of $H_{RC}49$ and hardness in the center of the thickness of $H_{RC}48.5$.

Figure 5:
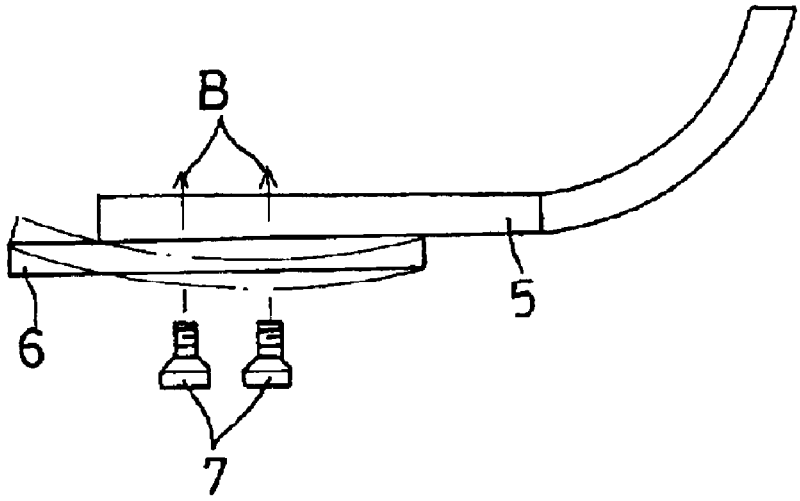
FIG. 5 is an explanatory diagram of an attachment state of the tooth to a lip in the first embodiment.

As shown in FIG. 5, the bucket tooth 6 warped as described above is fastened to the lip 5 with the warped concave surface facing the lip 5 by the fastening bolts 7, 7 (refer to the arrows B). By the fastening force, the bucket tooth 6 enters a straight state (shown by the solid lines) from the warped state (shown by alternate long and two short dashes lines) by elastic deformation. After the attachment, a resilient returning force is generated in the bucket tooth 6. Even when vibration, shock, or the like is applied to the bucket tooth 6 during operation and fluctuations in axial force occur in the fastening bolts 7, 7, the fluctuations in axial force can be absorbed by the resilient returning force. As a result, the axial force of the fastening bolts 7, 7 can be always held at a predetermined value, and occurrence of loosening of the bolts caused by reduction in axial force can be certainly prevented.

Figure 6:
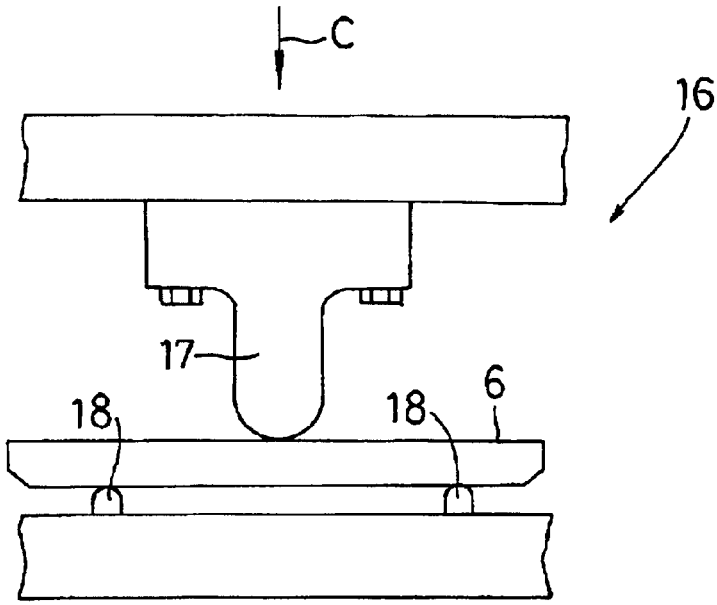
FIG. 6 is a structure diagram of the main portion of a press machine to warp the bucket tooth.

Although the embodiment has been described that the bucket tooth 6 is warped only by the heat treatment means, mechanical means may be used in combination with the heat treatment means. Specifically, after heating the bucket tooth 6 by a heating furnace, high-frequency heating, or the like to 500 to 600° C., a bending load is applied to the bucket tooth 6 by using a press machine 16 as shown in FIG. 6. After that, quenching and tempering are performed in a manner similar to the above.

The press machine 16 sandwiches the bucket tooth 6 by three points of a punch 17 having a portion which has a U-shape in cross section and comes into contact with a work (bucket tooth 6) and two supporting members 18, 18, and applies a load (load of 80 tons in the embodiment) in the direction of the arrow C to the punch 17, thereby warping the bucket tooth 6. Obviously, the load applied at this time is larger than the bending elastic limit of the bucket tooth 6. In the case of a small tooth (thin tooth), the face on the side which is not in contact with the lip near both ends of the tooth is supported at the time of heating in a furnace, and the tooth is austinitized in a style such that a weight is placed near a bolt hole, thereby enabling the tooth to be warped by the dead load of the weight.

Figure 7:
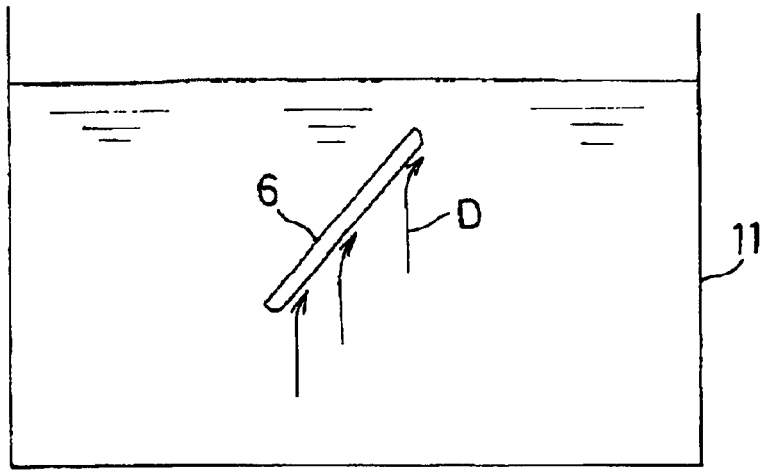
FIGS. 7(*a*) and 7(*b*) are diagrams showing other examples of a quenching method.
Figure 7:
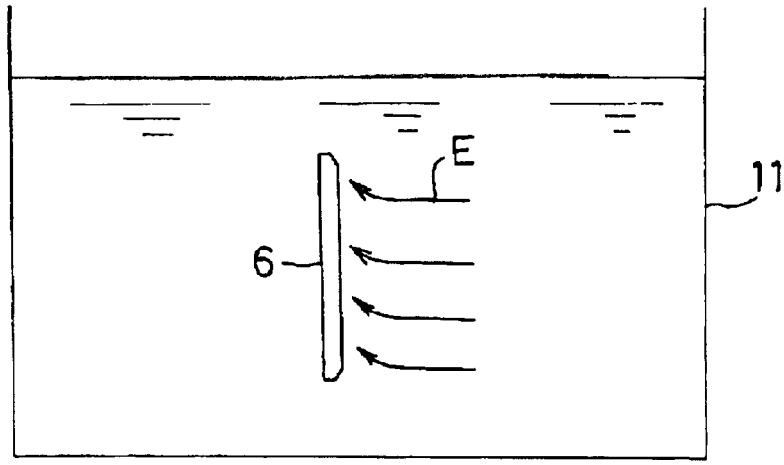

In the foregoing embodiment, the bucket tooth 6 is disposed horizontally in the quenching water tank 11 and the coolant (water) is circulated upward from the lower part by the jacket 12. The circulating direction of the coolant can be variously modified. FIGS. 7(*a*) and 7(*b*) show other examples of the circulating direction of the coolant. Specifically, FIG. 7(*a*) shows an example in which the bucket tooth 6 is disposed obliquely and the coolant is circulated in the direction of the arrows D so as to be along the under face side of the bucket tooth 6. FIG. 7(*b*) shows an example in which the bucket tooth 6 is disposed perpendicularly and the coolant is circulated in the direction of the arrows E so as to be along one of the faces of the bucket tooth 6. In both of the cases, the coolant is positively injected to the face as the convex face. With the constructions as well, effects similar to those of the foregoing embodiment can be obtained.

A required warp can be caused also by providing a decarburized layer on the face to be attached to the lip, of the bucket tooth. In the manufacturing process on the tooth material, that is, in the process of hot milling, a decarburized layer of about 0.7 mm is formed on the surface of the material. The decarburized layer on the face opposite to the face to be attached to the bucket lip is removed by milling and a heat treatment is performed under the above-described quenching conditions, thereby warping the face to be attached to the bucket lip in a concave state. It is unnecessary to give the directionality to the cooling method as in the above description. It is sufficient to uniformly cool the bucket tooth in a manner similar to a regular quenching operation. In such a manner, although the tooth itself expands at the time of martensitic transformation, only the decarburized layer shrinks. Consequently, the face on which the decarburized layer is formed is concaved.

Second Embodiment

Figure 8:
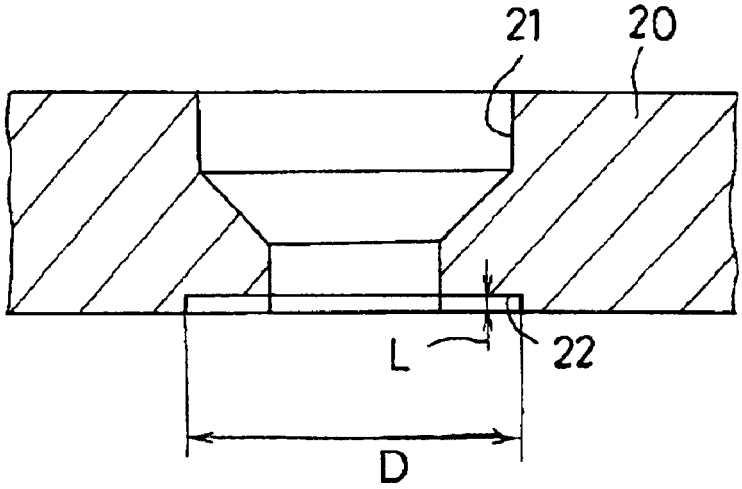
FIG. 8 is a cross section of a bucket tooth according to a second embodiment.
Figure 9:
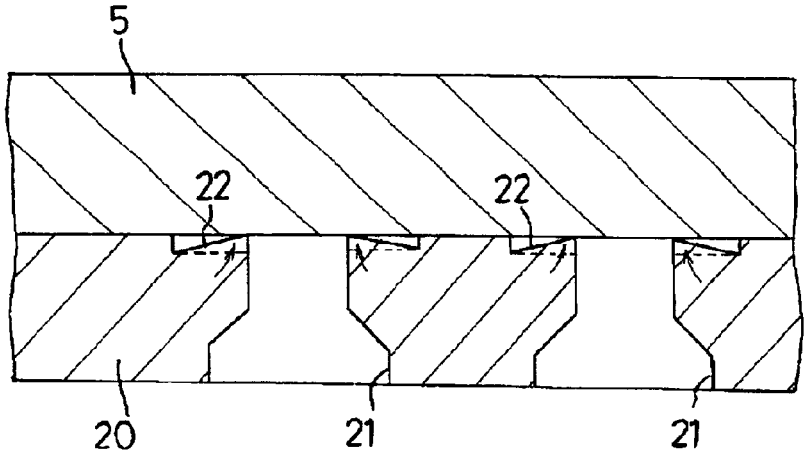
FIG. 9 is a cross section showing an attachment state of the bucket tooth in the second embodiment.

FIG. 8 is a cross section of a bucket tooth according to a second embodiment of the present invention. FIG. 9 is an explanatory diagram showing a state in which the bucket tooth is attached to a lip.

In the embodiment, in a bucket tooth 20, a spot facing portion 22 is formed around of a bolt hole 21 into which a fastening bolt is inserted on the side facing the lip 5. When the spot facing portion 22 is formed in such a manner, as shown in FIG. 9, the circumferential portion of the bolt hole 21 in the spot facing portion 22 is elastic deformed from the position of the alternate long and two dashes line to the position of the solid line by the fastening force at the time of bolting. Consequently, a resilient returning force is generated in the spot facing portion 22 during an operation after attaching the tooth. Fluctuations in the axial force of the fastening bolt are absorbed by the resilient returning force, so that the bolt is prevented from being loosened. Preferably, the ratio z of the depth L of the spot facing portion to the diameter D of the spot facing portion (L/D) is set, as obviously understood from results of a bolt loosening test which will be described hereinlater with reference to Table 1, to a value within the range of $2\ \text{mm/m} \leqq z \leqq 18\ \text{mm/m}$.

The reason why the spot facing portion 22 formed in the bucket tooth 20 produces an effect of preventing the bolt from being loosened will now be described with reference to FIGS. 10(*a*) and 10(*b*).

Figure 10:
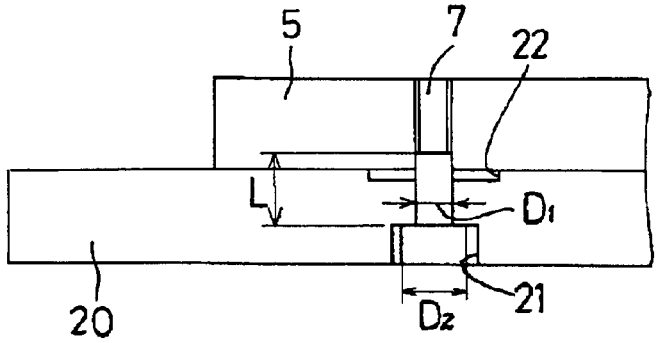
FIGS. 10(*a*) and 10(*b*) are diagrams for explaining effects of forming a spot facing portion.
Figure 10:
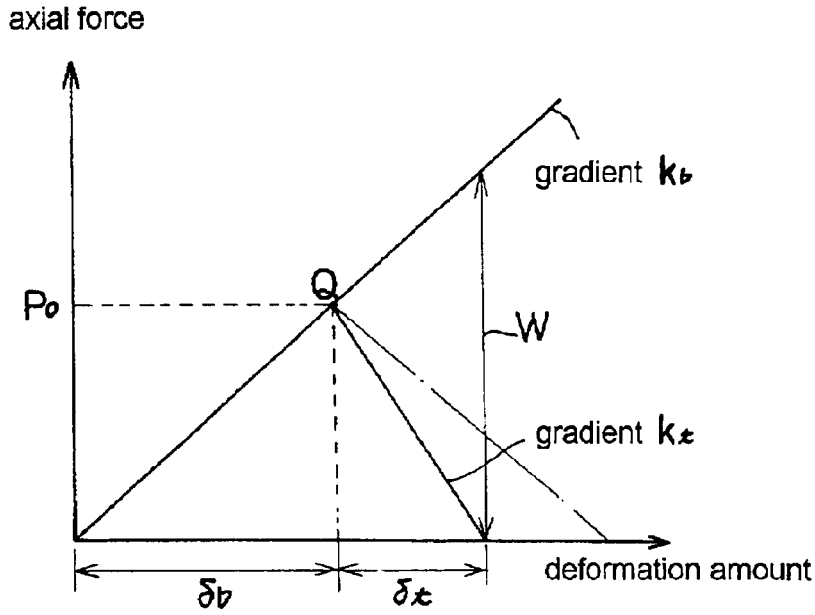

As simplifiedly shown in FIG. 10(*a*), a case where a threaded lip 5 and the bucket tooth 20 are fastened by the fastening bolt 7 will be examined. Assuming now that the diameter of the axis of the fastening bolt 7 is $D_1$ and the diameter of the head thereof is $D_2$, a sectional area $A_b$ of the fastening bolt 7 and a sectional area $A_t$ (area of the bearing surface of the bolt) of the fastened portion of the bucket tooth 20 are expressed by the following equations.

$$A_b=\pi(D_1/2)^2$$

$$A_1=\pi(D_2-D_1)^2/4$$

When the Young's modulus of the fastening bolt 7 is $E_b$, the Young's modulus of the bucket tooth 20 is $E_t$, and the length of the axial portion of the fastening bolt 7 is L, a spring constant $K_b$ of the fastening bolt 7 and a spring constant $K_t$ of the bucket tooth 20 are expressed by the following equations.

$$K_b=A_bE_b/L$$

$$K_t=A_1E_t/L$$

Further, an expanding amount $\delta_b$ of the fastening bolt 7 and a contracting amount $\delta_t$ of the bucket tooth 20 by an initial fastening force $P_0$ of the fastening bolt 7 are expressed by the following equations and can be shown in FIG. 10(*b*).

$\delta_b = P_0/k_b$ $\delta_t = P_0/k_t$

As obviously understood from FIG. 10(*b*), when an external force W acts in a state where the bucket tooth 20 is attached (state shown by a point Q), $\delta_t$ (contracting amount of the bucket tooth 20) becomes zero. When an external force larger than W acts, therefore, a gap occurs between the lip 5 and the bucket tooth 20 and the fastening bolt 7 is loosened. As a countermeasure against the loosening of the fastening bolt 7, as shown by an alternate long and short dash line in FIG. 10(*b*), it is sufficient to reduce the spring constant $k_t$ of the bucket tooth 20. By reducing the spring constant $k_t$, an allowance is made for $\delta_t$ with respect to the same external force.

In the embodiment, as a method of reducing the spring constant $k_t$, the spot facing portion 22 is formed in the bucket tooth 20. That is, by providing the spot facing portion 22, the value of the Young's modulus $E_t$ in the equation $k_t = A_t E_t / L$ can be reduced, so that the spring constant $k_t$ is reduced.

Although the case where the bucket tooth is warped, thereby causing elastic deformation in the bucket tooth at the time of attachment has been described in the first embodiment and the case where the spot facing portion is formed around the bolt hole in the bucket tooth to thereby cause elastic deformation in the spot facing portion at the time of attachment has been described in the second embodiment, an embodiment of both causing a warp and forming the spot facing portion is also possible.

In order to confirm the effects of the embodiments, a bolt loosening test was conducted. The test was carried out in such a manner that four bucket teeth were fastened to a hydraulic excavator of a 100-ton class by M60 fastening bolts (fastening torque of 15000±1000 Nm). Each of the bucket teeth has a width of 170 mm, a thickness of 70 mm, and an entire length of 950 mm. The bucket teeth were actually used for a regular excavating work for 300 hours and the axial force reduction rate after that was measured. The axial force measurement was carried out by using a pipe gauge adhered along a hole axially opened from the neck side of the fastening bolt along the center line of the fastening bolt and converting a change in a distortion before and after operation. A series of tests actually using the bucket teeth were repeatedly carried out while changing the warp amount (s) and the spot facing amount (z) of each of the bucket teeth. The results of the tests are shown in Table 1.

TABLE 1 results of bolt loosening tests

| No. | warp amount (S) | spot facing amount (Z) | axial force reduction rate (%) |
|---|---|---|---|
| 1 | 0.5 | 0 | 15.2 |
| 2 | 1 | 0 | 12.9 |
| 3 | 1.5 | 0 | 11.2 |
| 4 | 2 | 0 | 8.8 |
| 5 | 3 | 0 | 3.3 |
| 6 | 5 | 0 | 2.7 |
| 7 | 10 | 0 | 1.5 |
| 8 | 16 | 0 | 1.6 |
| 9 | 0 | 0.5 | 13.1 |
| 10 | 0 | 1 | 11.5 |
| 11 | 0 | 2 | 8.2 |
| 12 | 0 | 5 | 3.1 |
| 13 | 0 | 10 | 1.3 |
| 14 | 0 | 18.5 | 1.3 |

TABLE 1-continued results of bolt loosening tests

| No. | warp amount (S) | spot facing amount (Z) | axial force reduction rate (%) |
|---|---|---|---|
| 15 | 2 | 1.8 | 3.6 |
| 16 | 2 | 7 | 1.8 |
| 17 | 7.3 | 2 | 1.6 |

As obviously understood from the test results, both of measures (No. 1 to No. 8) of warping the bucket teeth and measures (No. 9 to No. 14) of forming the spot facing portion around the bolt hole could obtain the effect of preventing a reduction in axial force of the fastening bolt by increasing the warp amount (s) and the spot facing amount (z). A value of 10% or lower is obtained as an axial force reduction rate at which no problem occurs in practice when each of the warp amount (s) and the spot facing amount (z) is set to 2 mm/m or larger. If each of the warp amount (s) and the spot facing amount (z) is increased too much, an excessive tensile stress acts around the bolt hole when bolted and it causes delayed fracture. It is therefore necessary to provide the upper limit for each of the warp amount (s) and the spot facing amount (z). Preferably, the upper limit of the warp amount (s) is set as 15 mm/m and the upper limit of the spot facing amount (z) is set as 18 mm/m. It is understood from Table 1 that, in the cases (Nos. 15 to 17) where both the warping and the formation of the spot facing portion are used, the effect of preventing the reduction in axial force is more enhanced by the synergistic effect between them.

Third Embodiment

Figure 11:
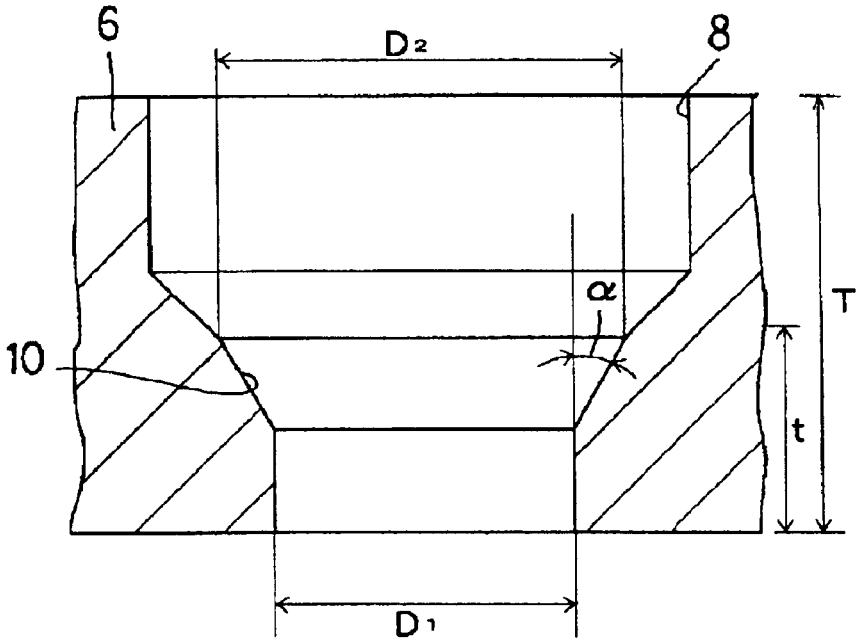
FIG. 11 is a cross section showing a shape of a bearing surface in a third embodiment.
Figure 12:
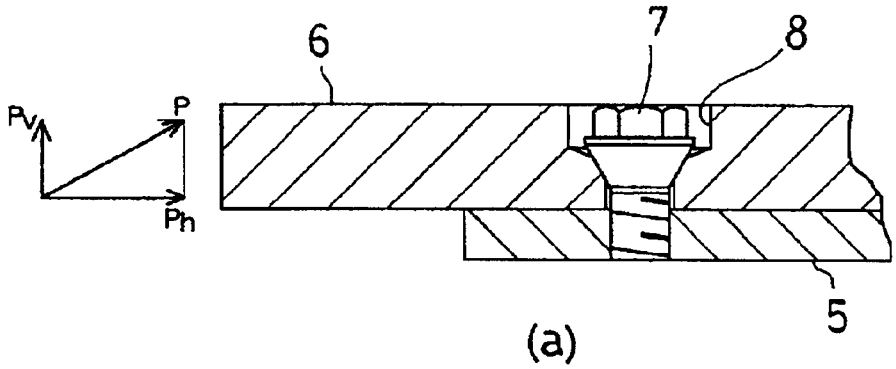
FIG. 12(*a*) is a cross section showing a bolted structure in the third embodiment and FIG. 12(*b*) is a partially enlarged view of FIG. 12(*a*).
Figure 12:
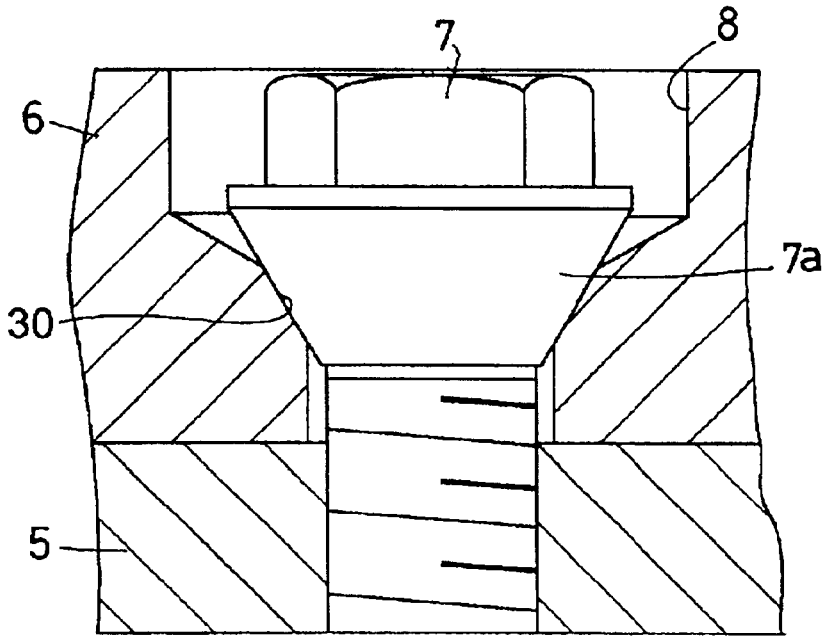

FIG. 11 is an enlarged section of a bolt hole (the shape of a bearing surface) in a bucket tooth of a third embodiment. FIGS. 12(*a*) and 12(*b*) are cross sections each showing the bolted structure of the third embodiment.

In the embodiment, a bearing surface 30 of the fastening bolt 7 in the bolt hole 8 (similar with respect to the bolt hole 9) opened in the bucket tooth 6 shown in FIG. 2 is formed in a tapered face which is tapered down in a bolt inserting direction as shown in FIG. 11. On the other hand, the fastening bolt 7 to be inserted into the bolt hole 8 has a shape having a tapered head 7*a* of a shape extending along the tapered bearing surface 30 as shown in FIGS. 12(*a*) and 12(*b*). The angle α of the bearing surface of the bolt hole 8 (9) is set to 30° in the embodiment.

With such a construction, in order to fix the bucket tooth 6 to the lip 5, tapping is made on the lip 5 side, the bolt hole 8 (9) of the bucket tooth 6 is overlapped with the tap hole in the lip 5, the fastening bolt 7 is inserted into the bolt hole 8 (9), and the tip of the fastening bolt 7 is screwed in the tap hole, thereby fastening the bucket tooth 6 and the lip 5. In the fastened state, the peripheral face of the tapered head 7*a* of the fastening bolt 7 matches with the tapered bearing surface 30 of the bolt hole 8 (9).

Figure 13:
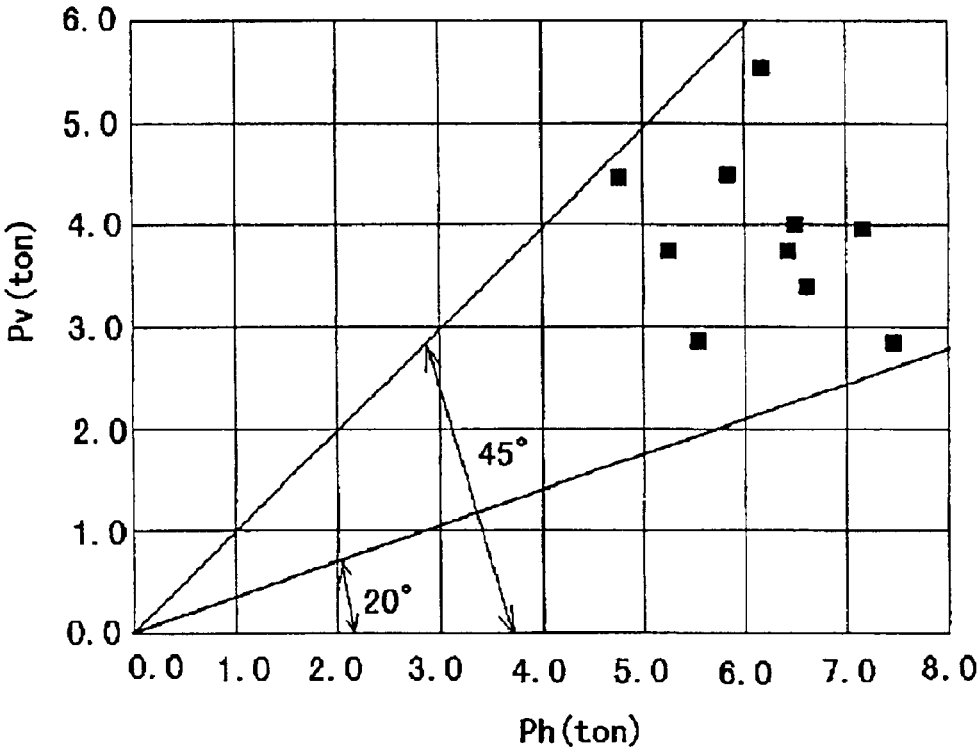
FIG. 13 is a graph showing a load acting on a bucket tooth in the third embodiment.

At the time of doing an excavating work and a loading work by using the bucket 1, a load P (having a horizontal component Ph and a vertical component Pv) acting on the bucket tooth 6 was measured, and results as shown in FIG. 13 were obtained. As obvious from the graph, it is understood that the direction of the load P is within the range from 20° to 45°.

By setting the bearing surface angle α to a value within the range from 20° to 45° on the basis of the results, the direction of the bearing surface 30 can be set to a direction almost perpendicular to the direction of the load acting on the bucket tooth 6 at the time of the excavating work and the loading work. The area for holding the axial force of the fastening bolt 7 is therefore enlarged and the load acting on the bucket tooth 6 can be uniformly received by the bearing surface 30. As a result, local fatigue does not easily occur in the bearing surface 30, the reduction in axial force of the fastening bolt 7 can be prevented, and the fastening bolt 7 can be accordingly prevented from being loosened.

In order to demonstrate the above, three kinds of bucket teeth manufactured with the bearing surface angles of 10°, 30°, and 50° were attached to the same lip with the axial force of 55 tons as a target, and the excavating work and the loading work were done for 50 hours. At this time, the axial force was measured on attachment of the teeth and after the 50-hour operation, and a concave or fatigue state of the bearing surface was also checked.

The main dimensions and the like of the bucket tooth and the fastening bolt used in the tests are as follows (refer to FIG. 11).

| | |
|---|---|
| tooth thickness | T = 54 mm |
| tooth width | W = 120 mm |
| tooth entire length | L = 600 mm |
| bolt diameter | $D_1$ = 36 mm |

bearing surface diameter $D_2$=40 mm (when the bearing surface angle is 10°), 50 mm (when the bearing surface angle is 30°), and 65 mm (when the bearing surface angle is 50°)

| | |
|---|---|
| thickness of lower plate of bearing surface | t = 25 mm |
| excavating force | P = 12 tons |
| bearing surface hardness | HRC46 |
| fastening bolt | JIS 12.9T class |

The results of the tests are shown in Table 2.

TABLE 2

| evaluation level (bearing surface angle) | initial axial force (ton) | axial force after 50-hour operation (ton) | axial force reduction rate (%) | fatigue in bearing surface |
|---|---|---|---|---|
| 10° | 57.5 | 46.5 | 19.1 | large |
| 30° | 55.5 | 53.0 | 4.5 | small |
| 50° | 56.0 | 49.0 | 12.5 | inter-mediate |

Figure 14:
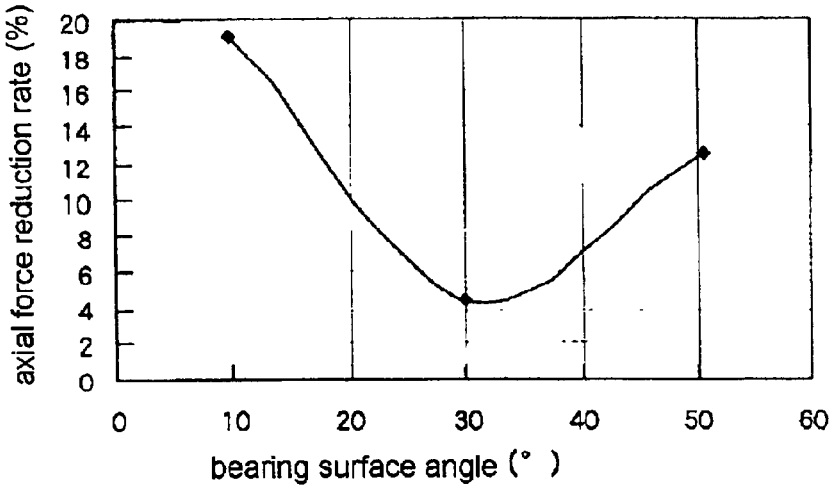
FIG. 14(*a*) is a graph showing the relation between a bearing surface angle and an axial force reduction rate and FIGS. 14(*b*) to 14(*d*) are diagrams for explaining shear components of a load applied on the bearing surface.
Figure 14:
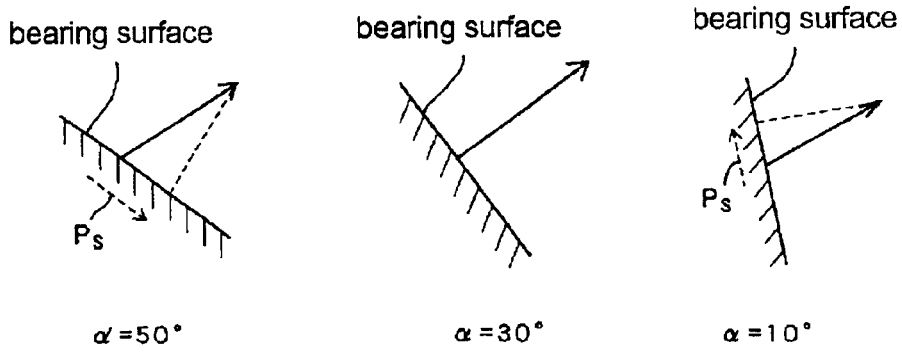

FIG. 14(*a*) is a graph showing the relation between the angle of the bearing surface and the axial force reduction rate on the basis of the test results.

As obviously understood from the results, the axial force reduction rate is the lowest and fatigue in the bearing surface is small in the case where the bearing surface angle is 30°. The reason can be considered that a load is applied almost perpendicularly to the bearing surface of a bolt as described above and is received by the entire bearing surface. On the other hand, in the cases where the bearing surface angles are 10° and 50°, conspicuous fatigue was observed. The following can be considered as a main cause. In the case of 10°, since the height of the bolt head is regulated by the thickness of the bucket tooth, the diameter of the bearing surface is small. Further, in the case of 10° and 50°, as compared with the case of 30°, the shear component $P_S$ (refer to FIGS. 14(*b*) to 14(*d*)) of the load acts more on the bearing surface, and the bearing surface slightly slides each time the load is applied so that fatigue is increased, thereby reducing the axial force of the bolt.

Fourth Embodiment

Figure 15:
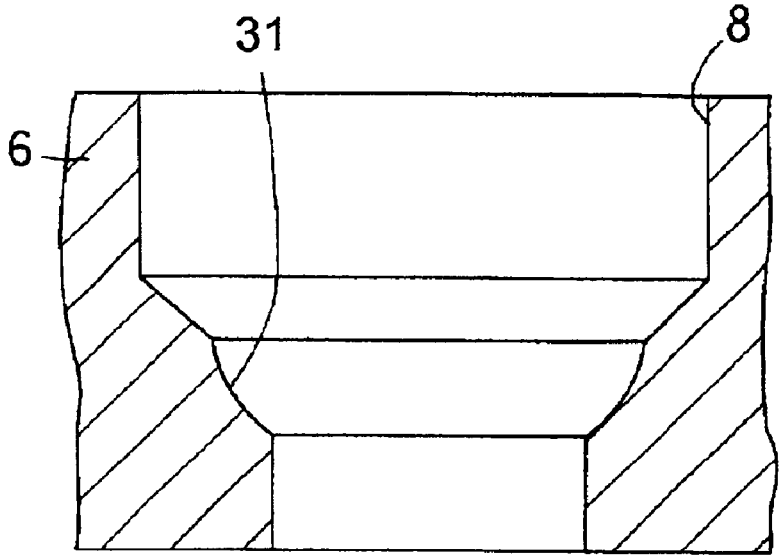
FIG. 15 is a cross section showing the shape of a bearing surface in a fourth embodiment.

FIG. 15 is an enlarged section of a bolt hole (the shape of a bearing surface) in a bucket tooth according to a fourth embodiment of the present invention.

In the embodiment, a bearing surface 31 of the fastening bolt is formed in a spherical curved face which is tapered in a bolt inserting direction. When it is formed in such a spherical curved face, the angle of a tangent of the curved face can be set to 20° to 45° (in the case of the embodiment, 20° to 42.6°). The tangent angle can be therefore directed almost perpendicular to the direction of the load acting on the bearing surface. In a manner similar to the third embodiment, therefore, the load can be received by the entire bearing surface of the bolt, so that local fatigue does not easily occur in the bearing surface. The reduction in axial force of the fastening bolt can be prevented and the fastening bolt can be certainly prevented from being loosened.

A test similar to that in the third embodiment was also conducted with respect to the case of the curved bearing surface by setting the radius of curvature of the bearing surface to 32 mm. The initial axial force of 54.0 tons, the axial force after 50-hour operation of 52.0 tons, and the reduction rate of the axial force of 3.7% were obtained. Consequently, a value smaller than the axial force reduction rate in the third embodiment can be obtained. It was confirmed that fatigue in the bearing surface is small.

Figure 16:
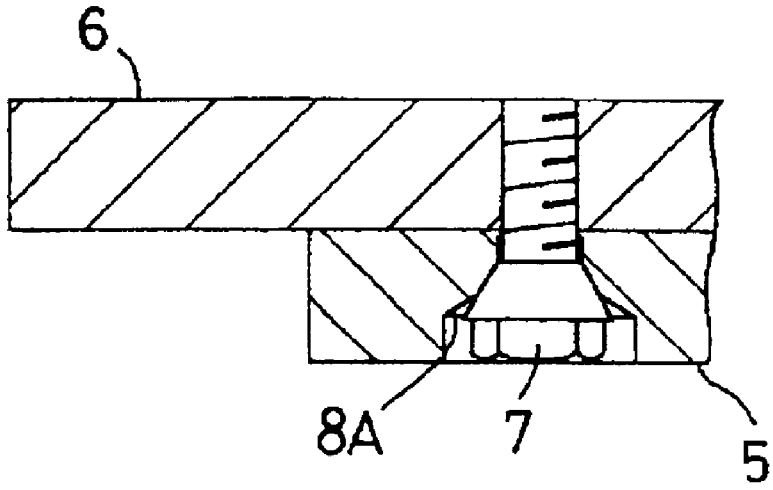
FIG. 16 is a cross section showing a bolted structure according to a modification of the third and fourth embodiments.

The foregoing embodiments have been described with respect to the cases where the lip 5 side is tapped, and the fastening bolt 7 is inserted from the bucket tooth 6 side to thereby fasten the bucket tooth 6 and the lip 5. As shown in FIG. 16, it is also possible to tap the bucket tooth 6 side, insert the fastening bolt 7 from the bolt hole 8A opened on the lip 5 side, and screw the tip of the fastening bolt 7 in a tap hole, thereby fastening the bucket tooth 6 and the lip 5. Obviously, in this case as well, the bearing surface of the fastening bolt 7 in the bolt hole 8A is formed in a face tapered in the bolt inserting direction or in a spherical curved face.

As described above, in the fastened structure of tapping the bucket tooth 6 or the lip 5 and fastening the bucket tooth 6 and the lip 5 by the fastening bolt 7, the screw portion can be made long and the load supporting portion is only the bolt head. Consequently, the number of fatigued portions in the bearing surface which cause reduction in axial force decreases. It produces an effect such that the bolt is not easily loosened.

Fifth Embodiment

Figure 17:
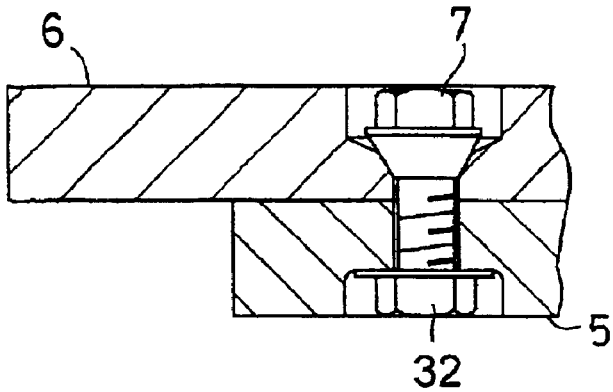
FIGS. 17(*a*) and 17(*b*) are cross sections each showing a bolted structure of a fifth embodiment.
Figure 17:
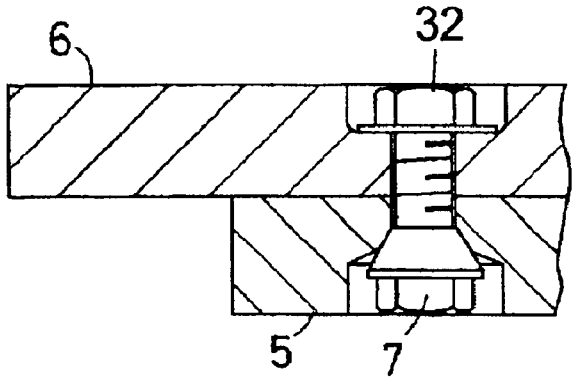

FIGS. 17(*a*) and 17(*b*) show cross sections of a bolted structure of a fifth embodiment of the present invention.

In the embodiment, by screwing the tip of the fastening bolt 7 inserted from the side of the lip 5 or the bucket tooth 6 into a nut 32 on the other side, thereby fastening the bucket tooth 6 and the lip 5 to each other. Specifically, in the example shown in FIG. 17(*a*), the head of the fastening bolt 7 is supported on the bucket tooth 6 side and the tip of the fastening bolt 7 is supported on the lip 5 side. In the example shown in FIG. 17(*b*), the head of the fastening bolt 7 is supported on the lip 5 side and the tip of the fastening bolt 7 is supported on the bucket tooth 6 side. In the embodiment as well, obviously, the bearing surface of the fastening bolt 7 in the bolt hole is formed in a surface tapered down in the bolt inserting direction or a spherical curved surface.

In such a fastened structure, even if the center axis of the bolt hole in which the fastening bolt 7 is inserted is deviated, uneven application of a load does not occur due to the axial deviation. The fastening bolt 7 is not therefore easily loosened. Since the length of the core of the fastening bolt 7 can be increased, a repetitive load acting on the fastening bolt 7 can be reduced. There is an advantage such that fatigue fracture does not easily occur in the fastening bolt 7.

Figure 18:
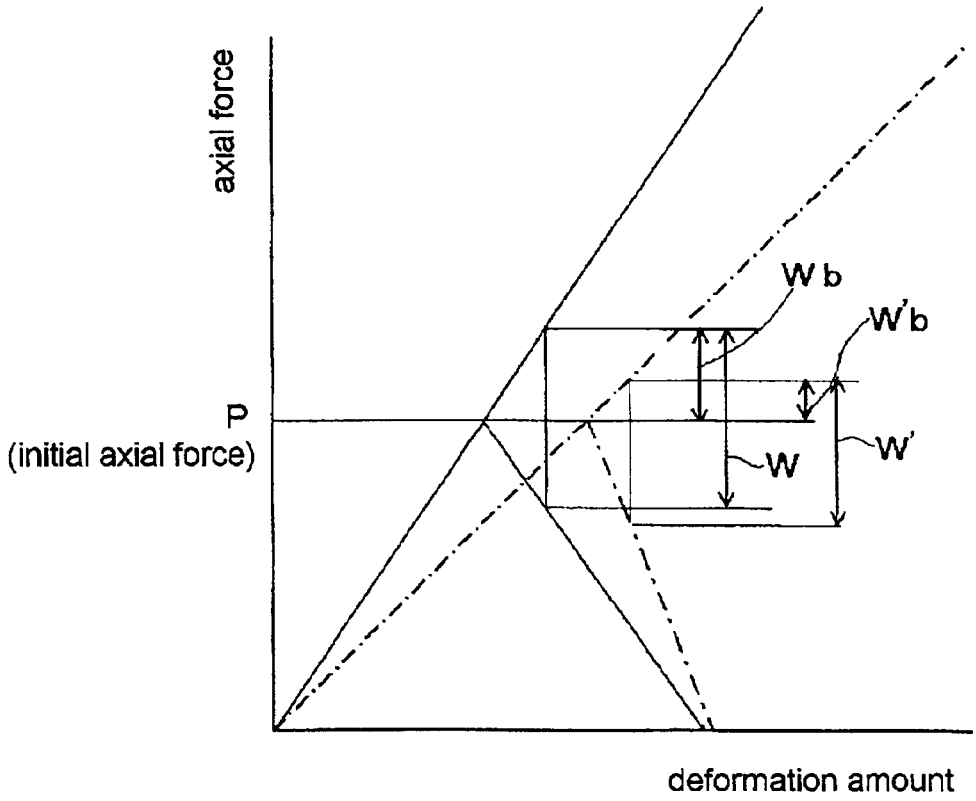
FIG. 18 is a diagram for explaining effects of the fifth embodiment.

The effect such that fatigue fracture does not easily occur in the bolt when the length of the core of the fastening bolt 7 increases will now be described with reference to FIG. 18. When the cross area of the fastening bolt 7 is $A_b$, the Young's modulus thereof is E, and the bolt core length thereof is L, the spring constant of the fastening bolt 7 is expressed by $A_bE/L$. When the bolt core length L increases, the spring constant decreases and the relation between the axial force and a deformation amount expressed by the solid line of FIG. 18 changes to the relation shown by an alternate long and short dash line of FIG. 18. When external forces W and W' are repeatedly applied, the relation between forces $W_b$ and $W_b'$ loaded on the fastening bolt becomes $W_b>W_b'$. The longer the bolt core length L is, the more the fastening bolt is not easily destroyed.

Sixth Embodiment

Figure 19:
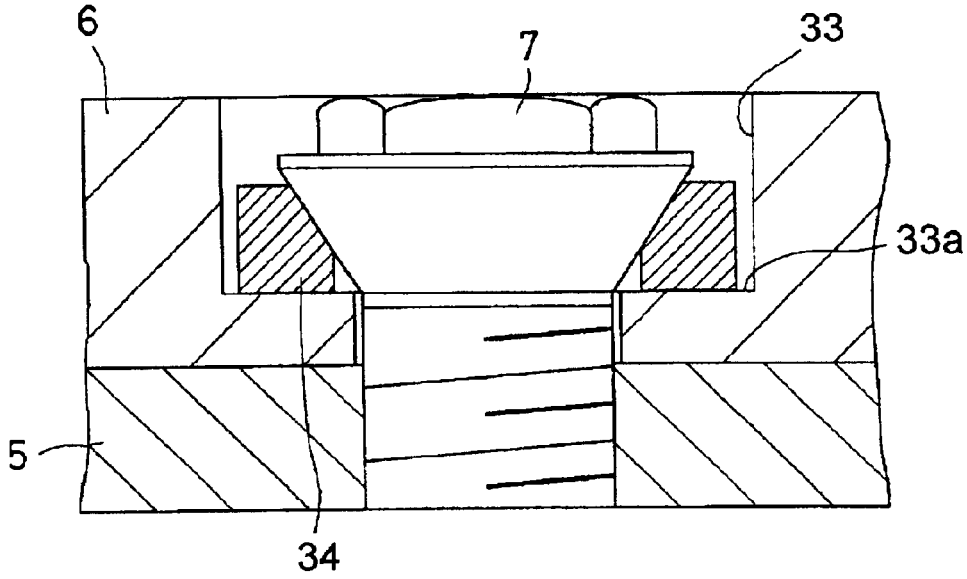
FIG. 19 is a cross section showing a bolted structure of a sixth embodiment.

FIG. 19 is a cross section of a bolted structure of a sixth embodiment of the present invention.

The third to fifth embodiments have been described with respect to the cases where the bearing surface in the bolt hole opened in the bucket tooth 6 or the lip 5 is processed in a surface tapered down in the bolt inserting direction or a spherical curved surface. In the sixth embodiment, a bolt hole 33 is processed in a shape having a step 33*a* at some midpoint. A taper washer 34 is fixed by the step 33*a* and is provided with an adjusting function. In such a construction, only by replacing the taper washer 34 with another, the taper washer 34 can be adapted to the tapered face of the fastening bolt 7. Thus, effort and the like necessary for precision process of the bolt hole can be omitted.

Although the case where the bolt hole 33 is formed in the bucket tooth 6 has been described in the embodiment, a similar construction can be also adopted in a case where the bolt hole 33 is formed on the lip 5 side. A similar construction can be also adopted in a fastened structure in which fastening is performed by a bolt and a nut as in the fifth embodiment.

Seventh Embodiment

Figure 20:
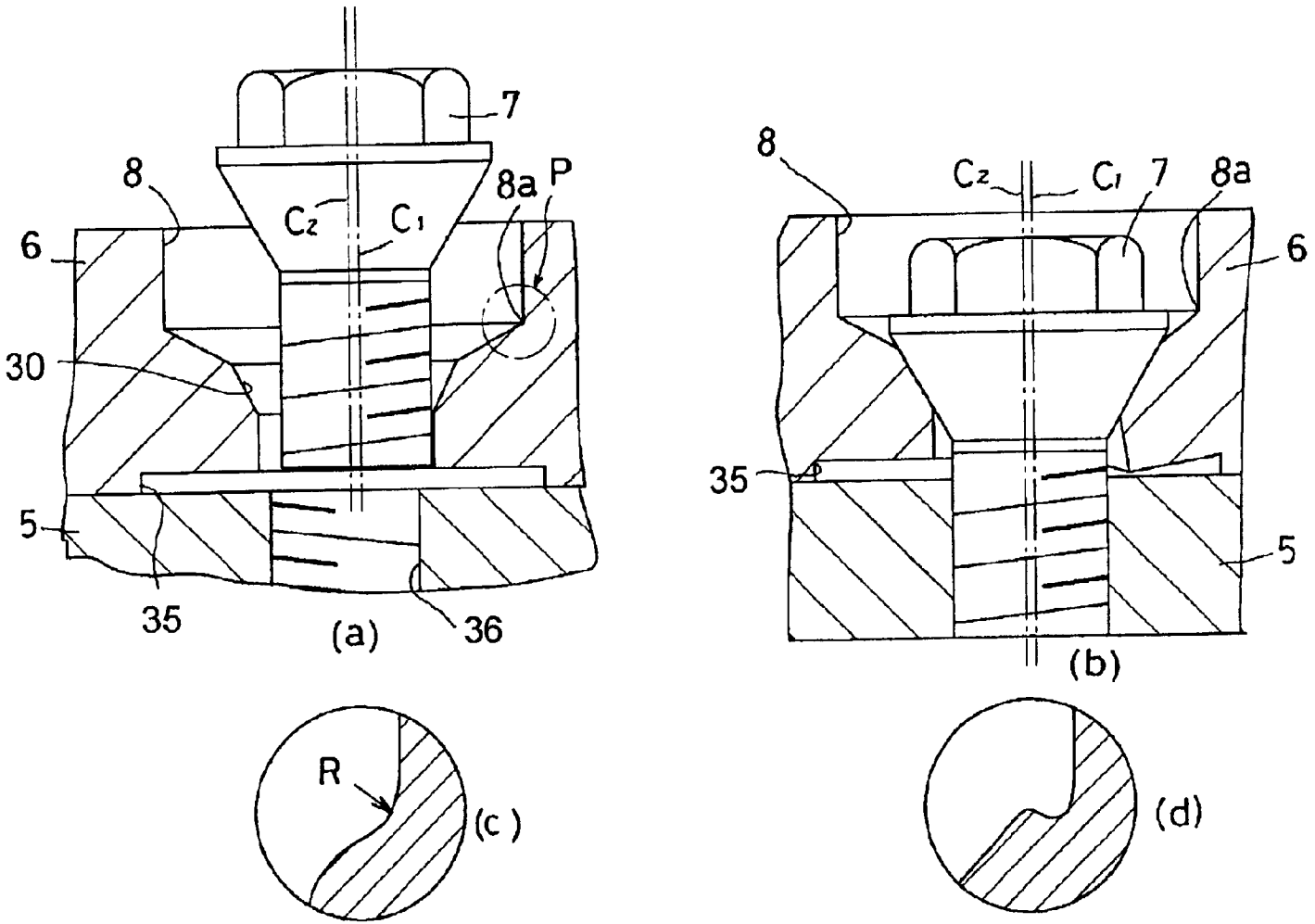
FIGS. 20(*a*) to 20(*d*) are diagrams showing a bolted structure of a seventh embodiment.

FIGS. 20(*a*) to 20(*d*) are explanatory diagrams of a bolted structure according to a seventh embodiment of the present invention.

In the embodiment, in addition to the construction of the tapered bearing surface or the spherical curved bearing surface in the third or fourth embodiment, a spot facing portion 35 is formed around the bolt hole 8 on the side facing the lip 5, in which the fastening bolt 7 is inserted. In addition to the construction, an upper corner 8*a* (indicated by P in FIG. 20(*a*)) in the bolt hole 8 is formed in a shape which is easily deformed.

In such a construction, even in the case where the bucket lip and the bucket tooth are fastened in a state where the center line $C_1$ of the fastening bolt 7 and the center line $C_2$ of the tap hole 36 are deviated from each other as shown in FIG. 20(*a*), they are fastened in a state where the spot facing portion 35 on the side close to the center line $C_1$ of the fastening bolt 7 is resilient deformed as shown in FIG. 20(*b*). Means for forming the upper corner 8*a* in a shape which can be easily deformed includes, for example, a method of forming the upper corner 8*a* in a shape indicated by R having a radius of curvature of 5 or larger as shown in FIG. 20(*c*) and a method of providing a recess as shown in FIG. 20(*d*).

As in the embodiment, by using both the bearing surface which is formed in the tapered or spherical curved surface and the spot facing portion 35, also in the case where the center line $C_1$ of the fastening bolt 7 and the center line $C_2$ of the tap hole 36 are not deviated from each other, the spot facing portion 35 is resilient deformed by the fastening force at the time of fastening the bolt, and a resilient return force is generated in the spot facing portion 35 during the operation after the tooth was attached. Fluctuations in axial force of the fastening bolt are therefore absorbed by the resilient return force, and the bolt is prevented from being loosened. By a synergistic effect between the effect of preventing the bolt from being loosened by the bearing surface and the effect of preventing the bolt from being loosened by the spot facing portion 35, the bolt can be more certainly prevented from being loosened.

Figure 21:
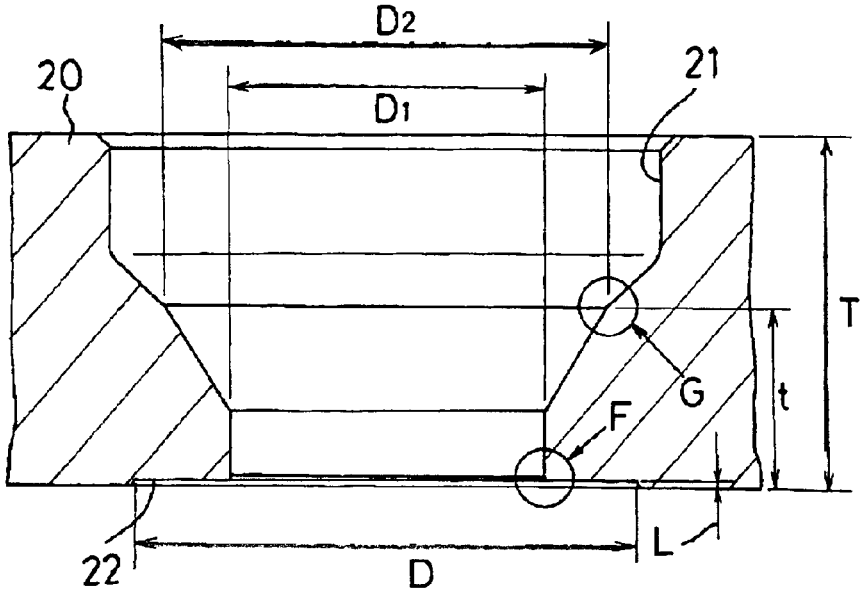
FIG. 21 is a diagram for explaining a method of setting the diameter and the depth of a spot facing portion.

With reference to FIG. 21, a method of setting the diameter D and the depth L of the spot facing portion 22 formed in the bucket tooth 20 will be described.

First, at the time of selecting a fastening bolt for fastening the bucket tooth 20 to the lip 5, a load applied to the bolting portion is dynamically obtained from the excavating force of the bucket and the tooth shape (thickness, width, and entire length), and the bolt material, the bolt diameter $D_1$, the bearing surface diameter $D_2$, and the bearing surface lower plate thickness (t) are derived from the obtained load. Preferably, the material of the fastening bolt is at the JIS 12.9 level and the hardness of the tooth is $H_{RC}$46 to 52.

After determining the shape of the bolt hole 21 in such a manner, as dimensions in which portions indicated by reference characters F and G in FIG. 21 are not fatigued, the diameter D and the depth L of the spot facing portion 22 are determined. If the diameter D of the spot facing portion 22 is smaller than the diameter $D_2$ of the bearing surface, the portion F in FIG. 21 is fatigued. Consequently, it is required that the following equation is satisfied.

$$D \geqq D_2 = 1.5\ (D_1 \pm 10)$$

On the other hand, when the depth z of the spot facing portion 22 is set to a large value, the thickness t of the lower plate of the bearing surface accordingly decreases, and the portion G in FIG. 21 is plastic deformed, so that the effects of the present invention cannot be obtained. In order to prevent this, it is therefore required that the following equation is satisfied.

$$L \leqq 0.2t = 0.16\ (D_1 \pm 10)$$

When the depth L of the spot facing portion 22 is too small, the effects of the present invention cannot be obtained. It is consequently necessary to satisfy at least the following equation.

$$L \geqq 0.02t = 0.016\ (D_1 \pm 10)$$

Figure 22:
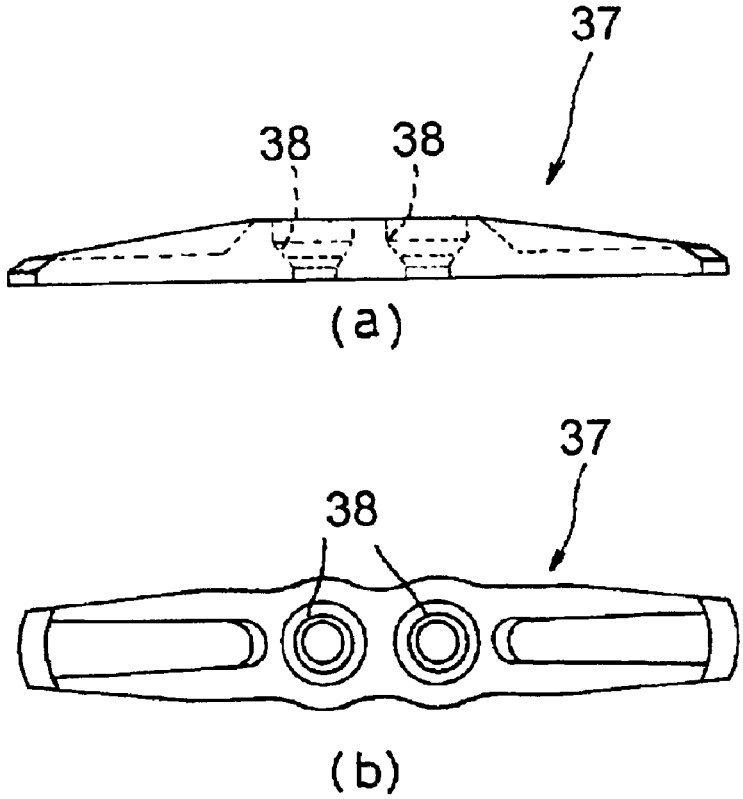
FIGS. 22(*a*) and 22(*b*) are a side view and a plan view, respectively, showing an example of a forged bucket tooth.
Figure 23:
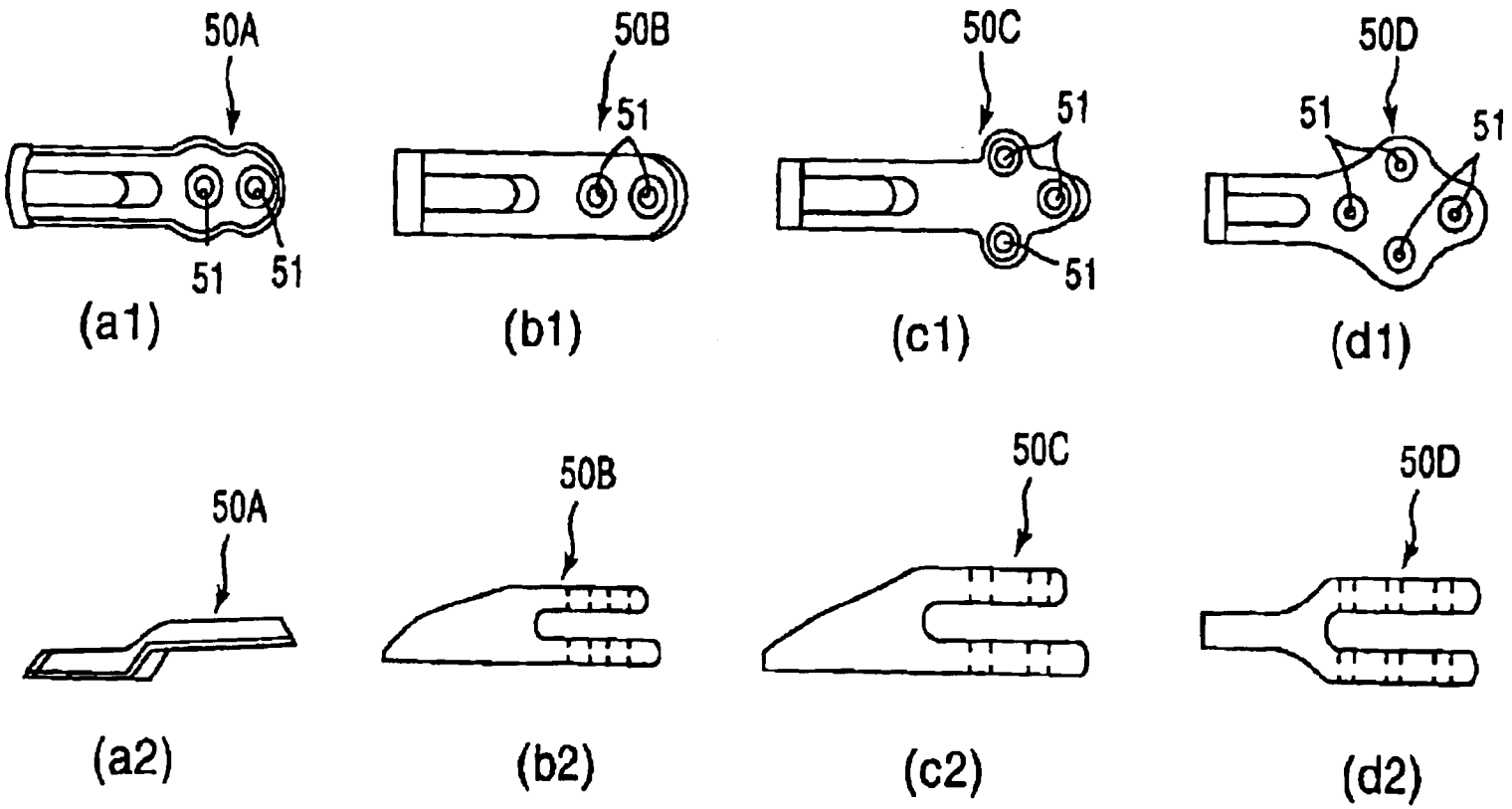
FIG. 23 PRIOR ART
FIGS. 23(*a*1) and 23(*a*2) to FIGS. 23(*d*1) and 23(*d*2) are diagrams showing examples of a conventional bucket tooth of a bolted type.
Figure 24:
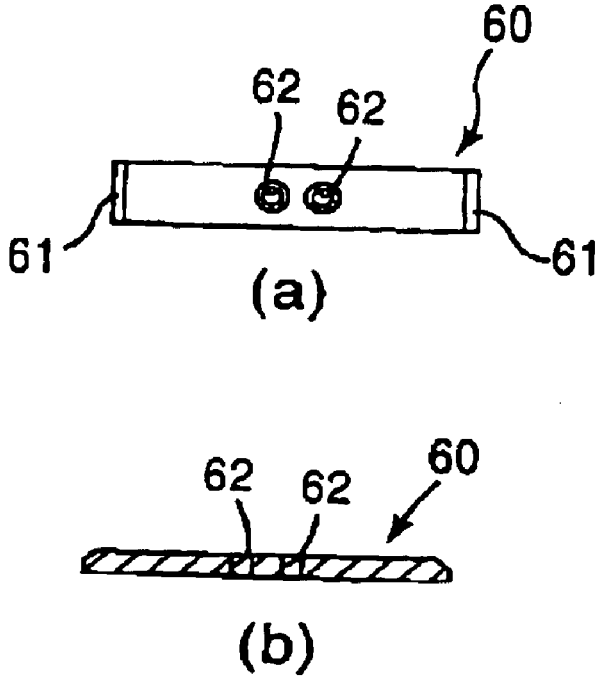
FIG. 24 PRIOR ART
FIGS. 24(*a*) and 24(*b*) are diagrams showing another example of the conventional bucket tooth of a bolted type.

Although a bucket tooth made by a metal plate has been described in each of the embodiments, as a matter of course, the present invention can be applied to a forged bucket tooth. A forged bucket tooth 37 has a shape, for example, as shown in FIGS. 22(*a*) and 22(*b*) and is obtained by forming a round bar or a square bar as a material into a tooth shape by hot forging. Subsequent processes such as a process of forming a bolt hole 38 and heat treatment are similar to those of the foregoing embodiments. The detailed description is not therefore repeated here.

What is claimed is:

1. In an assembly having a bucket tooth attached to a bucket lip via a fastening bolt, said bucket tooth having a pre-set warp and comprising axial force fluctuation absorbing means for absorbing fluctuations in axial force of said fastening bolt after attaching one face side of said bucket tooth to face said bucket lip, wherein said pre-set warn of said bucket tooth provides a space between said bucket lip and bucket tooth before fastening therewith, and wherein said axial force fluctuation absorbing means provides resilient return force during said fluctuations in axial force by the forcible straightening of said pre-set warp of said tooth because said one face side is bolted in a state where said one face side is positioned on the bucket lip side.

2. The bucket tooth according to claim 1 wherein said warp is caused around a bolt hole into which the fastening bolt is inserted as a center, and an amount s of the warp is set to value satisfying an equation of 2 mm/m$\leqq$s$\leqq$15 mm/m.

3. The bucket tooth according to claim 1, wherein said axial force fluctuation absorbing means provides said resilient return force by spot facing a circumferential portion of a bolt hole, in which said fastening bolt is inserted, on said one face side facing said bucket lip.

4. The bucket tooth according to claim 3, wherein a ration (z) of a depth L of the spot facing to a diameter D of the spot facing (=L/D is set to a value satisfying an equation of 2 mm/m$\leqq$z$\leqq$18 mm/m.

5. In an assembly having a bucket tooth attached to a bucket lip via a fastening bolt, said bucket tooth having a pre-set warp and comprising axial force fluctuation absorbing means for absorbing fluctuations in axial force of said fastening bolt after attaching one face side of said bucket tooth to face said bucket lip, said axial force fluctuation absorbing means acting to cause or increase a gap between said one face side and said bucket lip, about the point of attachment, by action of a resilient return force found in the material from which said bucket tooth is fabricated, wherein said axial force fluctuation absorbing means provides said resilient return force during said fluctuations in axial force by the forcible straightening of said pre-set warp of said tooth because one face side is bolted in a state where said one face side is positioned on the bucket lip side, and by spot-facing of a circumferential portion of a bolt hole, in which the fastening bolt is inserted, on said one face side facing said bucket lip.

6. The bucket tooth according to claim 5, wherein a ratio (z) of a depth L of the spot facing to a diameter D of the spot facing (=L/D) is set to a value satisfying an equation of 2 mm/m$\leqq$z$\leqq$18 mm/m.

* * * * *

UNITED STATES PATENT AND TRADEMARK OFFICE

CERTIFICATE OF CORRECTION

PATENT NO. : 6,865,829 B2
DATED : March 15, 2005
INVENTOR(S) : Amano et al.

It is certified that error appears in the above-identified patent and that said Letters Patent is hereby corrected as shown below:

Title page,
Item [30], Foregin Application Priority Data, change "Dec. 2, 1999 (JP) …… 11-3431106" to be -- Dec. 2, 1999 (JP) ……11-343106 --

Signed and Sealed this

Thirty-first Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,865,829 B2
DATED : March 15, 2005
INVENTOR(S) : Amano et al.

It is certified that error appears in the above-identified patent and that said Letters Patent is hereby corrected as shown below:

Column 15,
Line 16, change "pre-set warn of" to be -- pre-set warp of --

Signed and Sealed this

Nineteenth Day of July, 2005

JON W. DUDAS
*Director of the United States Patent and Trademark Office*